US008396610B2

(12) United States Patent
Mashiach

(10) Patent No.: US 8,396,610 B2
(45) Date of Patent: Mar. 12, 2013

(54) SYSTEM FOR DETECTING A SUSPECTED AREA

(75) Inventor: Yaacov Mashiach, Kefar Hanagid (IL)

(73) Assignee: Israel Aerospace Industries Ltd., Lod (IL)

( * ) Notice: Subject to any disclaimer, the term of this patent is extended or adjusted under 35 U.S.C. 154(b) by 725 days.

(21) Appl. No.: 12/509,824

(22) Filed: Jul. 27, 2009

(65) Prior Publication Data

US 2010/0036544 A1 Feb. 11, 2010

(30) Foreign Application Priority Data

Aug. 4, 2008 (IL) ..... 193216

(51) Int. Cl.
*G05D 1/00* (2006.01)
*E21B 43/00* (2006.01)

(52) U.S. Cl. ..... 701/2; 701/23; 701/300; 700/253; 104/138.2; 343/719; 180/167

(58) Field of Classification Search ..... 701/23–28, 701/300–302; 700/253; 104/138.2; 343/719; 180/167

See application file for complete search history.

(56) References Cited

U.S. PATENT DOCUMENTS

| | | | | |
|---|---|---|---|---|
| 6,035,786 | A * | 3/2000 | McKay et al. | 104/138.1 |
| 6,108,597 | A * | 8/2000 | Kirchner et al. | 701/23 |
| 6,199,016 | B1 * | 3/2001 | Zuykov | 702/16 |
| 6,694,233 | B1 * | 2/2004 | Duff et al. | 701/23 |
| 6,842,674 | B2 * | 1/2005 | Solomon | 701/23 |
| 7,131,344 | B2 * | 11/2006 | Tarumi | 73/865.8 |
| 7,188,568 | B2 | 3/2007 | Stout | |
| 2008/0215185 | A1 * | 9/2008 | Jacobsen et al. | 700/259 |
| 2010/0012320 | A1 * | 1/2010 | Vail, III | 166/285 |
| 2010/0211354 | A1 * | 8/2010 | Park et al. | 702/165 |

FOREIGN PATENT DOCUMENTS

JP 2000015509 A * 1/2000

OTHER PUBLICATIONS

Hollingum, Robots explore underground pipes, 1998, Industrial Robot, vol. 25, No. 5.*

* cited by examiner

*Primary Examiner* — Thomas Black
*Assistant Examiner* — Sara Lewandroski
(74) *Attorney, Agent, or Firm* — Oliff & Berridge, PLC

(57) ABSTRACT

It is well known that tunnels in many cases have been proven as an efficient means to overcome counter trespassing means and enable hostile entities to infiltrate a boarder or other restricted area. There is provided a method and system for efficiently detecting and locating underground tunnels.

According to certain aspects, of the invention there is provided a system and method for detecting a suspected area, comprising an underground pipe array disposed substantially in horizontal orientation under the ground and including at least two pipes, the at least two pipes being disposed at different depths, at a predefined distance one with respect to the other, each of the at least two pipes creating an underground pathway infrastructure for accommodating at least one mobile vehicle; each one of the mobile vehicles being equipped with at least sensing and navigation devices for patrolling along a respective pipe, in a coordinated manner, for detecting a suspected area; the predefined distance is designed to be within an effective operational distance of the sensing and navigation devices; command and control, configured to control at least the mobile vehicles, gathering and processing the vehicles' data and creating an updated situation awareness picture of the underground medium.

33 Claims, 8 Drawing Sheets

SYSTEM FOR DETECTING A SUSPECTED AREA

FIELD OF THE INVENTION

This invention relates to detecting suspected areas such as tunnels.

BACKGROUND OF THE INVENTION

Many organizations such as drug dealers attempt to trespass a border for the purpose of, say, smuggling goods or drugs or in accordance with another example, hostile entities may attempt to smuggle military equipment or even soldiers or terrorists for damaging soldiers/civilians or property of their enemies at the other side of the border.

Employing conventional means for trespassing borders may be relatively easily detected in particular in borders which are heavily guarded by manned and/or unmanned guarding means.

Tunnels in many cases have been proven as an efficient means to overcome the counter trespassing means. Tunnels may be dug from one side of the border down to few tens of meters (say up to 40) underneath the ground, cross the border line and exit at the other side of the border line. Tunnels may be the width of a meter or so, allowing humans to crawl through the tunnel or alternatively to shift smuggled goods from one side of the tunnel and collect the goods or humans at the other side of the border. As is well known, it is extremely difficult to locate tunnels. Consider, for example, the border line between Israel and the Gaza strip, which extends to about 50 km. The likelihood of locating a tunnel that resides 40 m underneath the ground, at a width of say 1 meter, is very small. It should be noted that, normally, known per se sensors such as acoustic and seismic sensors are limited in their detection range to say up to 10 meters (depending on the particular ambient conditions) due to inherent poor signal to noise ratio when sensing ground medium and, accordingly, employing sensors of the kind specified for detecting a digging activity or an already existing tunnel at a depth of about 30 or 40 meters, is likely to fail.

There is thus a need in the art to provide a system and method for locating suspected areas such as tunnels.

SUMMARY OF THE INVENTION

According to a first aspect of the invention, there is provided a system for detecting a suspected area, comprising: an underground pipe array disposed substantially in horizontal orientation under the ground and including at least two pipes, the at least two pipes being disposed at different depths, at a predefined distance one with respect to the other, each of the at least two pipes creating an underground pathway infrastructure for accommodating at least one mobile vehicle; each one of the mobile vehicles being equipped with at least sensing and navigation devices for patrolling along a respective pipe, in a coordinated manner, for detecting a suspected area; the predefined distance is designed to be within an effective operational distance of the sensing and navigation devices; command and control, configured to control at least the mobile vehicles, gathering and processing the vehicles' data and creating an updated situation awareness picture of the underground medium.

According to certain embodiments the system is configured such that one or more of the mobile vehicles accommodate at least one mole vehicle capable, in response to detection of a suspected area, of being launched from the mobile vehicle towards the suspected area for validating the suspected area.

According to a second aspect of the invention, there is provided a system for detecting a suspected area, a command and control configured to control at least mobile vehicles and capable of controlling the vehicles gathering and processing the vehicles' data and creating an updated situation awareness picture of an underground medium; the command and control configured to perform at least the following: obtain a mission plan; send mission commands to the mobile vehicles; collect data from the vehicles; and process the so collected data. In cases where the processed data indicate a suspected area, a validation sequence commences that includes sending to a mobile vehicle a launch command for launching a mole vehicle that is accommodated in the mobile vehicle, for guiding the mole vehicle to drill towards the suspected area in order to determine whether the suspected area is validated or not.

According to a third aspect of the invention there is provided a system for detecting a suspected area, a mobile vehicle being equipped with at least sensing and navigation devices for patrolling along a pipe disposed under the ground, for detecting a suspected area.

According to a fourth aspect there is provided a system for detecting a suspected area, a mole vehicle accommodated within a mobile vehicle capable of patrolling an underground pathway, the mole vehicle is capable, in response to detection of a suspected area, of being launched from the mobile vehicle towards said suspected area for validating the suspected area.

Still further, in accordance with another aspect of the invention there is provided a method for detecting an underground suspected area, comprising providing an underground pipe array disposed substantially in horizontal orientation under the ground and including at least two pipes, the at least two pipes being disposed at different depths, at a predefined distance one with respect to the other, each of the at least two pipes creating an underground pathway infrastructure for accommodating at least one mobile vehicle; each of the vehicles patrolling along a respective pipe, in a coordinated manner, for detecting a suspected area by the mobile vehicles; each one of the mobile vehicles being equipped with at least sensing and navigation devices; the predefined distance is designed to be within an effective operation distance of the sensing and navigation devices; and controlling at least the mobile vehicles, gathering and processing the vehicles' data and creating an updated situation awareness picture of the underground medium.

According to certain embodiments of the invention the method further comprises launching at least one mole vehicle from the mobile vehicle towards said suspected area, in response to detection of suspected area; and utilizing the mole vehicle for validating the suspected area.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF THE INVENTION

Figure 1:
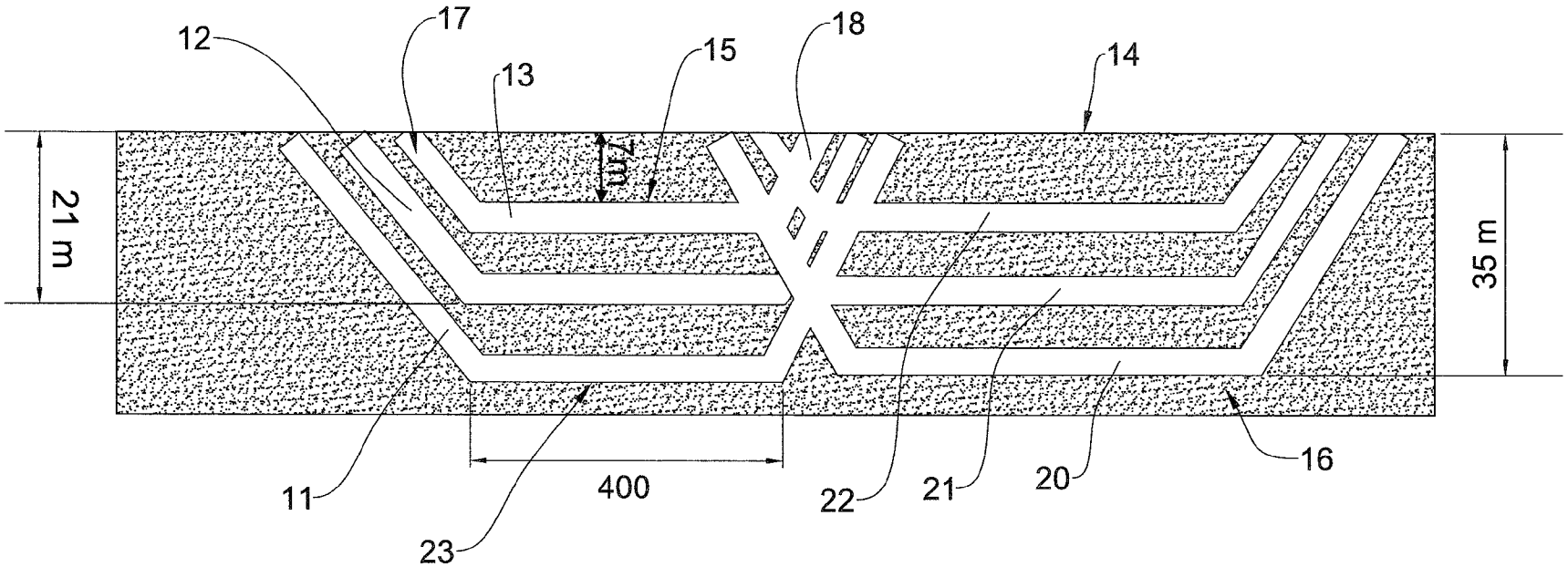
FIG. 1 illustrates an example of a pipe array, for use in a system according to certain embodiments of the invention.

Turning now to FIG. 1, there is shown an example of a pipe array, for use in a system according to certain embodiments of the invention. By this particular example three underground polyethylene pipes 11, 12 and 13, each one built from sections in a length of 400-2000 meters, are disposed substantially in horizontal orientation relative to the ground surface 14. The horizontal orientation is illustrated for example by viewing the main portion 15 of the upper pipe 13 which, as shown, is parallel to the surface 14. The term "substantially in horizontal orientation" does not require that the orientation of the pipe is necessarily parallel to the ground (which obviously may have a varying surface shape) and not necessarily be geometrically horizontal. The "substantial horizontal orientation" aims to emphasize that the main portion of the pipes e.g. 15 (obviously excluding the end section, e.g. 17 or 18) extends along the surface and is not normal (or close to normal) thereto in a vertical orientation. By this specific example the pipes each have a horizontally oriented section length of at least 400 meters and are disposed at different depths, at a predefined distance one with respect to the other, i.e. 7 meters 21 meters and 35 meters. The array of pipes shown in FIG. 1 includes two segments, a first segment 23 comprising pipes 11 to 13 and a second segment 16 which in turn includes another three pipes 20, 21, and 22 having similar characteristics as pipes 11 to 13.

The disposition of the pipes under the ground can be performed by way of example using a known per se drilling process designated Horizontal Directional Drilling (HDD). As also shown each pipe has two ends extending to the surface (see for instance ends 17 and 18 of pipe 13).

Those versed in the art will readily appreciate that the specified number of pipes in an array, the number of segments, the length of each pipe section, the respective depths, the pipe's type (polyethylene pipes), the disposition technique as well as other characteristics of the pipe array, are all provided for illustrative purposes only and are by no means binding.

Figure 2:
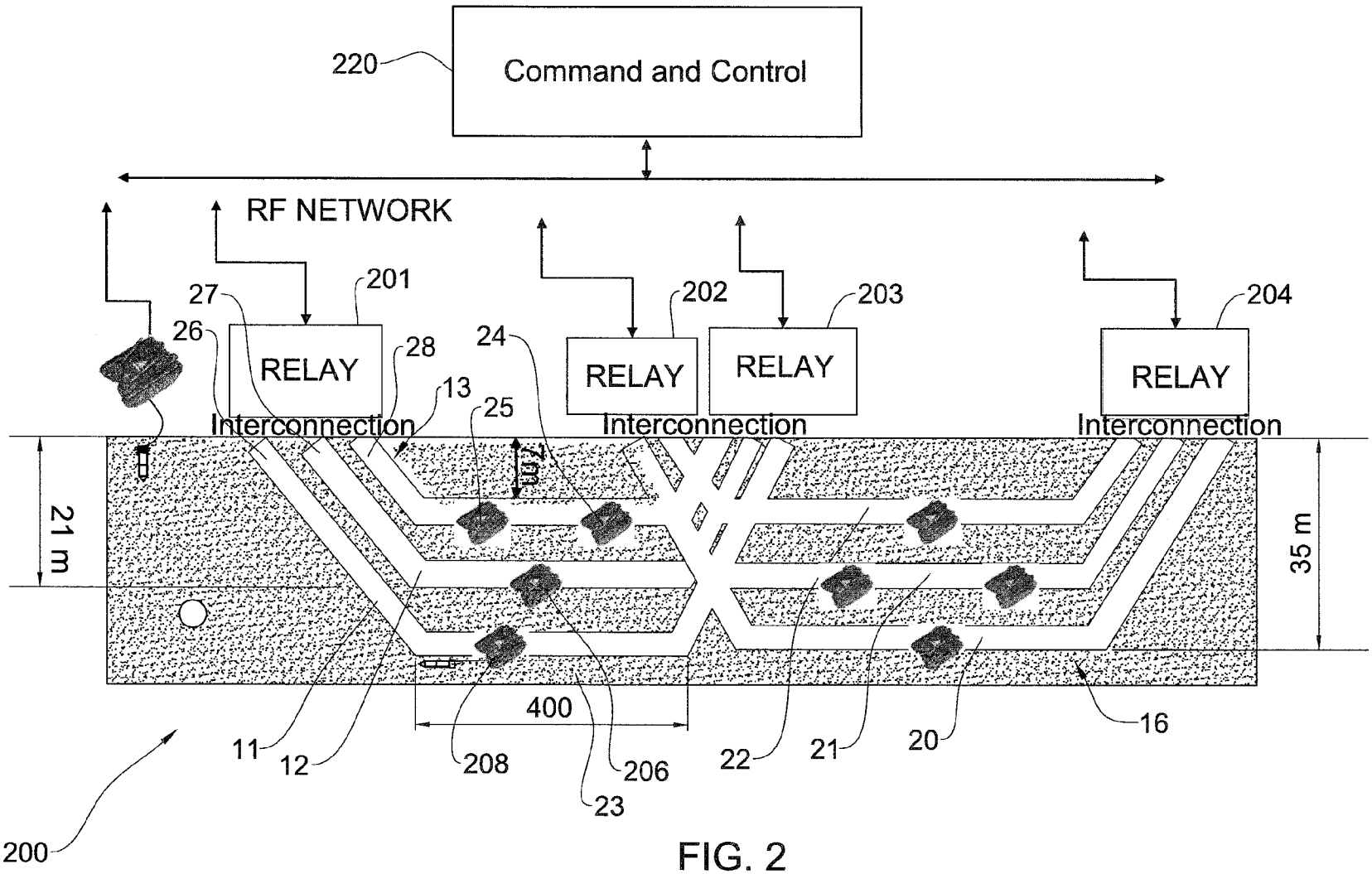
FIG. 2 depicts a schematic illustration of a system for detecting a suspected area, according to certain embodiments of the invention.

Turning now to FIG. 2, there is shown a schematic illustration of a system for detecting a suspected area, according to certain embodiments of the invention. As shown the system includes the specified array of pipes 200 (discussed in detail FIG. 1) where, as shown, each pipe creates an underground pathway infrastructure for accommodating at least one mobile vehicle (otherwise referred to as a "robot" or "robot system"). Thus, pipe 13 serves as a pathway to two mobile vehicles 25 and 24 which can patrol along the pipe for detecting and validating a suspected area, such as tunnels.

In a similar fashion, and as shown in FIG. 2, the other pipes accommodate mobile vehicles which serve the same purposes.

The structure of the mobile vehicle and its manner of operation will be discussed in greater detail below.

Figure 2A:
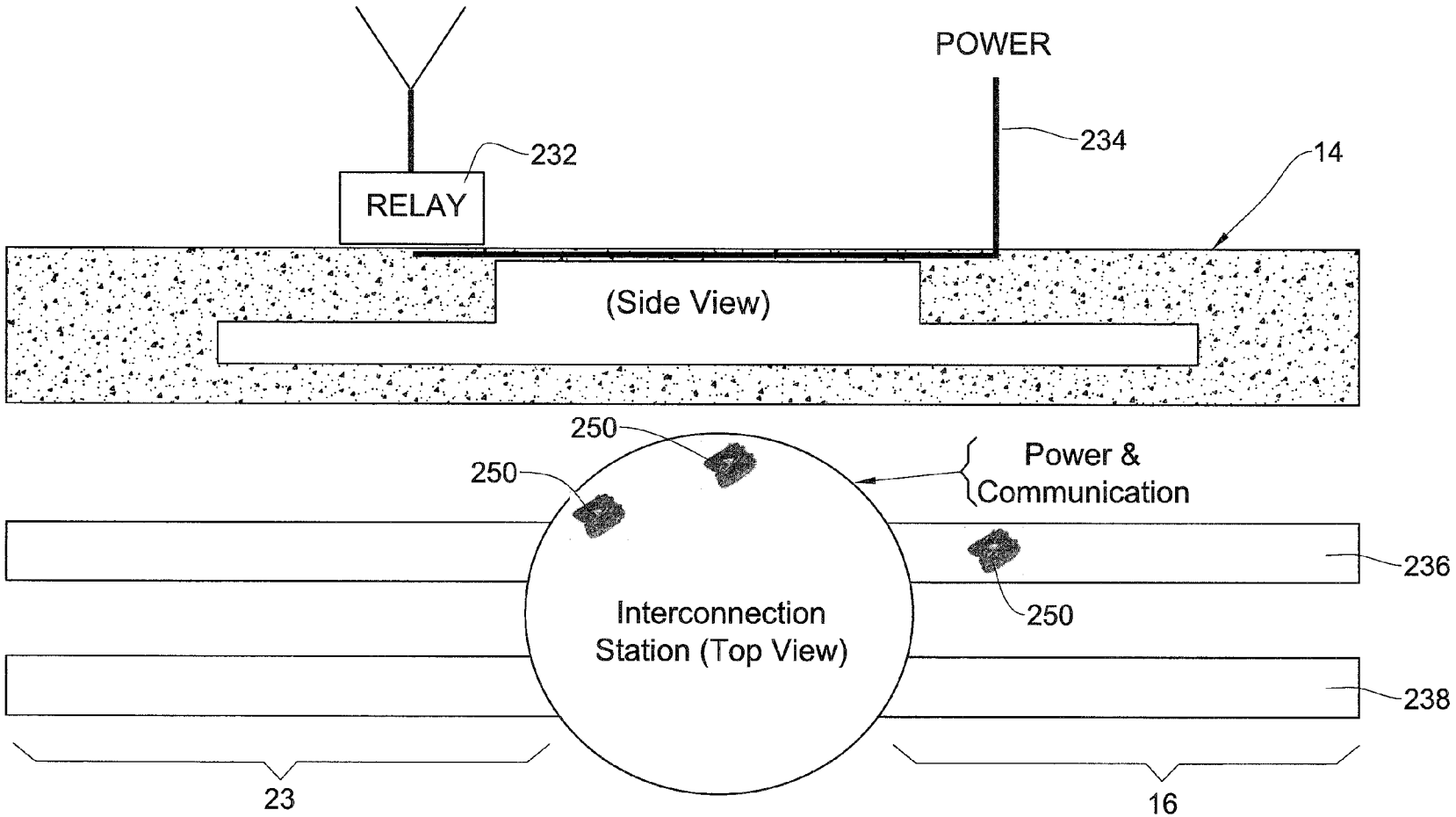
FIG. 2A illustrates schematically an interconnection unit, in accordance with certain embodiments of the invention.

Note that in accordance with certain embodiments, the interconnection station (as shown in FIG. 2A) enables connection between any two pipes serving as a common pathway for at least one of said mobile vehicles. This is illustrated by way of example with reference to FIG. 2, where pipe 13 is linked to pipe 22 serving thus as an extended pathway to the mobile vehicles. Also shown in FIG. 2 are end sections of the pipes extending through the surface of the ground (see for example ends 26 to 28 of the pipes on the left side of FIG. 2).

FIG. 2A illustrates schematically an interconnection unit, in accordance with certain embodiments of the invention. FIG. 2A shows a side view and a top view of the interconnection unit. In the side view illustration, a relay station 232 (similar to elements 201-204 in FIG. 2) and a power unit 234 are shown on top of the surface of the ground 14 above a tunnel 230. Relay station 232 and power unit supply communication and power, respectively to mobile units located in the tunnel beneath the ground. It should be noted that although the side view in FIG. 2A shows a single tunnel close to the surface of the ground, the interconnection unit is configured to serve multiple tunnels one beneath the other and is not limited to a single tunnel.

In the top view illustration it can be seen that mobile vehicles 250 can pass from one segment of pipes 16 on one side of the interconnection unit to another segment of pipes 23 on the other side of the interconnection unit. Mobile vehicles can also use an interconnection unit to pass between different pipe levels, for example from an upper pipe 22 to a lower pipe 21.

As shown in the side view of FIG. 2A, the interconnection unit, in accordance with some embodiments, is wider than a single tunnel. Thus, in a scenario where more than one array of tunnels are disposed in the ground one after the other (236, 238) in order to provide greater security, mobile vehicles can use the interconnection unit in order to pass from one array to the other.

The mobile vehicles may operate in two modes:

1. In accordance with a certain embodiment, semiautonomous mode, where the vehicle gets its mission from a Command and Control (referred to occasionally also as C&C) center, performs the mission, sends data to the C&C and waits for operator approval or new mission
2. Manual mode where the vehicle is teleported by the operator of the C&C.

In both cases the data of the sensors onboard the mobile vehicle is transmitted to the C&C where it is processed and displayed to the operator in a way that enables him to understand the underground picture—this display is called situation awareness display. The other displays provide vehicle data for monitoring and operating the vehicle. The C&C is configured for gathering and processing the data received from the mobile vehicles and creating an updated situation awareness picture of the underground medium. The operation of the command and control (C&C) system will be discussed in greater detail below.

Note that the invention is not bound by the specified modes of operation.

The mobile vehicles require power supply and communication with the command and control system. In accordance with certain embodiments, the mobile vehicles are configured to communicate with the command and control through wire or a wireless network. In accordance with a certain embodiment the network employs relays fitted at the end section of the pipes. Thus, by way of example, the mobile vehicles communicate through relays 201 to 204, which relay the two way communication between the mobile vehicles and the command and control system 220.

The relay's function is to create the wire or wireless connection between the C&C and the vehicles. Each vehicle is addressed by its number creating an address to a specific relay which acts as a gateway between the vehicles and the C&C enabling a two way transmission of data and video between the vehicles and the C&C.

In accordance with certain embodiments, the mobile vehicles are configured to receive power through power units fitted at the end section of said pipes.

Figure 3A:
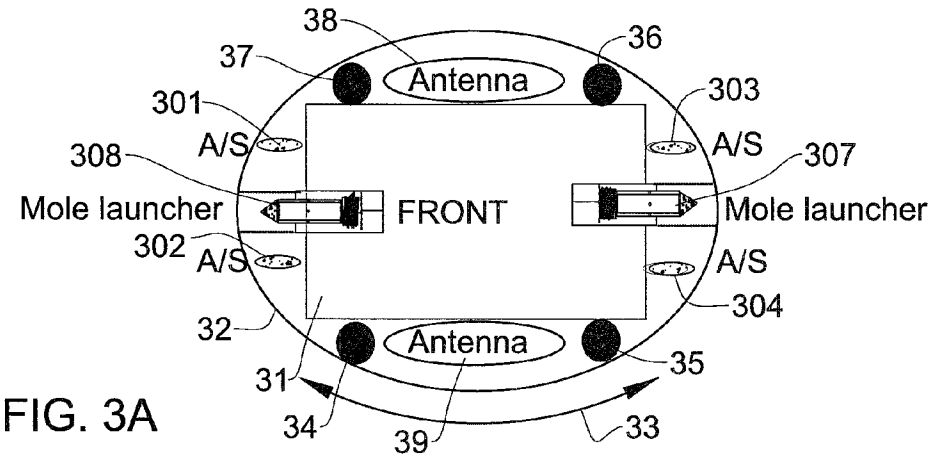
FIGS. 3A, 3B illustrate schematically a front view and a side view, respectively, of a mobile vehicle in accordance with certain embodiments of the invention.
Figure 3B:
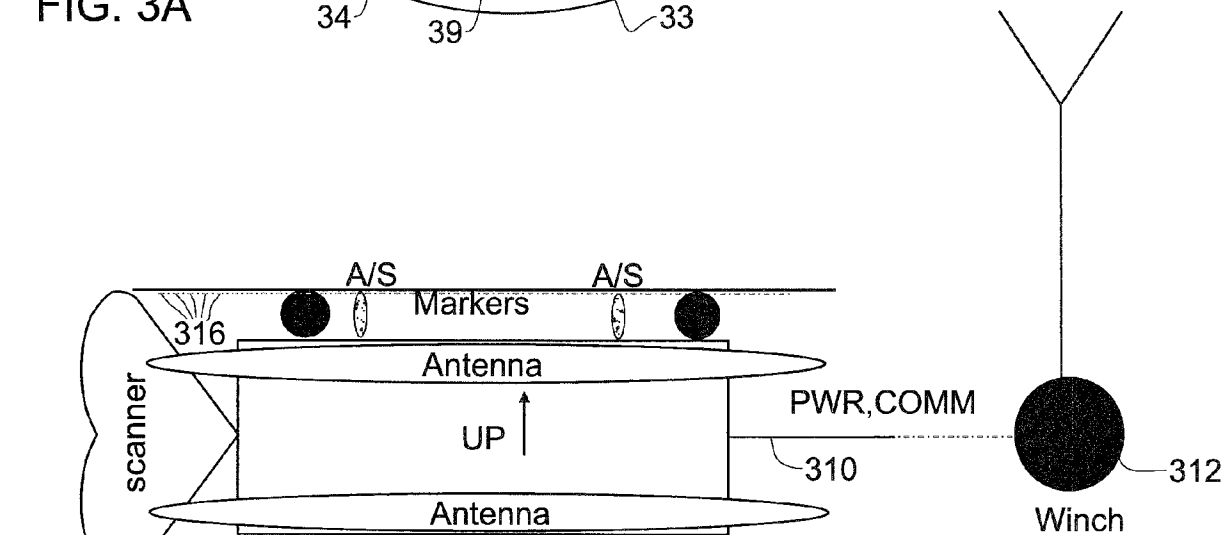

Turning now to FIG. 3A-B, they illustrate schematically a front view and a side view, respectively, of a mobile vehicle in accordance with certain embodiments of the invention. As shown in FIG. 3A, the mobile vehicle 31 is capable of moving in various orientations. Thus, for example, the vehicle can move forward and backward along the pipe (whose circumference is depicted schematically as 32) and further capable of moving in a circumferential direction (in a direction designated by arrow 33) by means of four wheels 34 to 37. This motion capability allows the vehicle to arrive to any desired location in the pipe at a relatively high accuracy of, say few centimeters.

In accordance with certain embodiments, the vehicle is equipped with at least two types of sensing sensors 1. Acoustics/Seismic
2. Radar The mobile vehicle is further equipped with radar antennas (in this example, two antennas 38 and 39) more specifically, with up and down antennas enabling transmission in two directions.

As specified above, the mobile vehicle is equipped with generally known per se sensing means such as Acoustic/Seismic (designated as A/S) (four of which 301 to 304 are depicted in FIG. 3A) as well as optional Magnetic flow (not shown in FIG. 3A) and the radar specified above.

Note that in accordance with certain embodiments, the sensors' main modes of operation are:

Change Detection

Detects new tunnels or new equipment in the tunnels

Detection of Existing Tunnels

Detection of existing voids by applying different radar mapping and tomography techniques and fusion with the other sensors' data.

The mobile device is further equipped with navigation means (such as a laser scanner which scans and monitors the markers on the pipe for localization within the pipe) allowing the vehicle to patrol along the pipe(s) for detecting suspected area(s).

Turning now to FIG. 3B, there is shown a schematic side view of the mobile vehicle. In addition to the wheels and antennas, there is shown a power supply and communication provided through cables 310 which are coupled to the relays (see FIG. 2) through a winch 312 and therefrom to the external world (e.g. to the command and control 220 by means of RF network, discussed with reference to FIG. 2 above).

In accordance with certain embodiments, the winch includes a built-in mechanism to keep the cable in a tensioned state in order not to interfere with the smooth motion of the vehicle. The navigation device of the mobile vehicle further employs a known per se scanner (of which scanning bean 314 is shown), for scanning the pathway for detecting obstacles which may interfere with smooth motion of the vehicle as well as for navigating the vehicle.

As shown in FIG. 3A, the mobile vehicle may further accommodate at least one mole vehicle (of which two 307 and 308 are shown in FIG. 3) capable, in response to detection of a suspected area, of being launched from the mobile vehicle towards the suspected area, for validating the suspected area (such as tunnels) all as will be explained in greater detail below.

Thus, in accordance with certain embodiments the mobile vehicle is capable of moving silently inside the pipe according to the defined mission, equipped with acoustic/seismic and radar sensors, and receives data from and processes and transmits data to the Command & Control. Note that in accordance with certain embodiments the pipe's internal surface includes markers 316 which assist the (mobile) vehicle's navigation system to determine its self location within the pipe, and is obviously required for navigating to a designated suspected area. According to certain embodiments, the navigation of the mobile vehicle is performed by an inertial navigation system, which is known to drift in time, while the markers are used in order to compensate for at least part of the navigational errors generated by the inertial navigation.

In accordance with certain embodiments, the vehicle is capable of doing maintenance missions inside the pipe such as for example, cleaning the pipe from obstacles and debris, repairing the pipe (e.g. replacing a damaged marker), etc.

Note the description with reference to FIG. 3 is provided for illustrative purposes only. Thus, the orientation of the motion of the vehicle, the dimensions of the vehicle relative to the pipe the manner of motion (wheels) as well as their number and location of the types and number of sensors, the means for provision of communication and/or power and/or other characteristics of the mobile vehicle are all provided for illustrative purposes only and are by no means binding.

Figure 4:
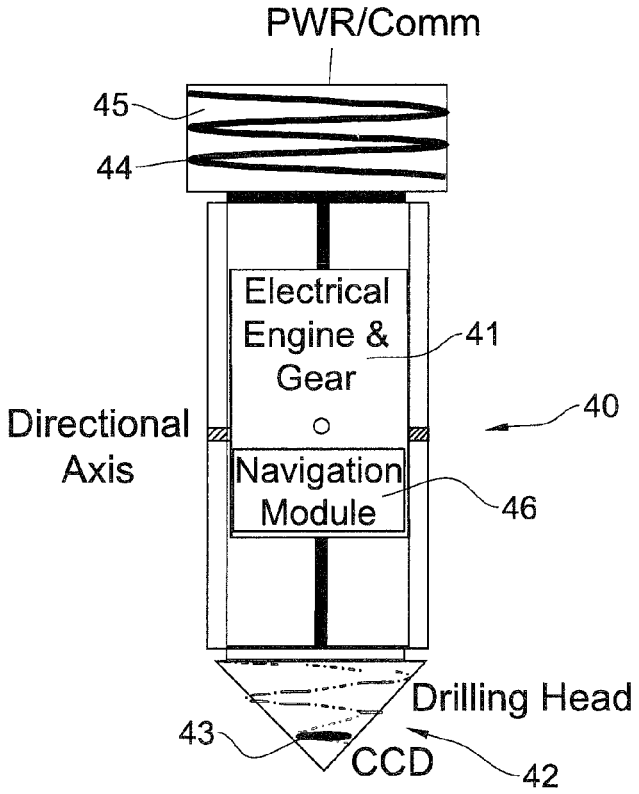
FIG. 4 illustrates schematically a mole vehicle, in accordance with certain embodiments of the invention.

Attention is now drawn to FIG. 4 illustrating schematically a mole vehicle 40 in accordance with certain embodiments of the invention.

In accordance with certain embodiments, the mole vehicle is composed of an electrical engine and gear modules 41 configured to propel the vehicle in backward and forward directions at a designated drilling speed (of say, 10 meters per hour). The mole vehicle further employs a navigation module 46 configured to provide appropriate commands to the electrical engine and gear for guiding the mole vehicle to a desired location.

Note that in accordance with certain embodiments, the mole vehicle is actually controlled manually by the operator in the C&C via the connection to the mobile vehicle through the relay. The mole vehicle has a small navigation unit 46 inside. Navigation data is sent by the operator who is guiding the mobile vehicle to the suspected point of the tunnels, discovered by the sensors, and processing is performed on the C&C.

The mole vehicle is further equipped with a drilling head 42 configured to drill the ground (at a pace of, say 10 meters per hour). The head of the mole vehicle performs the drilling operation and is able to open at a certain point and enables an imaging means 43 such as CCD to acquire an image of the nearby area, for validating the suspected area. The mole vehicle may possibly employ also a seismic sensor (not shown). The seismic sensor will facilitate navigation of the mole vehicle towards the suspected area (e.g. suspected tunnel) for validation by getting a positive change in the signal level as the mole drills towards the tunnel and a negative change as it drills backward. In accordance with certain embodiments, the image acquisition means may acquire images of the area in the vicinity of the drilling head. These images may be transmitted from the mole vehicle through the mobile vehicle to a command and control station and may be viewed on a display allowing the operator to have a visual view of the area and assisting him to determine whether the suspected area is a tunnel, or not, all as will be explained in greater detail below.

The mole vehicle 40 is configured to receive power and exchange communication with the mobile vehicle 31 through a cable 44 accommodated in compartment 45. In accordance with certain embodiments, the mole vehicle includes also a warhead such as an Explosive Cartridge (not shown in FIG. 4) configured to destroy the validated area, for example, in the case of a tunnel, once the suspected area is validated as a tunnel. It should be noted that full validation of the tunnel occurs when the operator sees the tunnel in his display and confirms that the picture he gets is a tunnel. In response to the specified validation, a warhead can be activated (e.g. by invoking an appropriate command by the operator at the command and control station) for damaging or destroying the tunnel.

Those versed in the art will readily appreciate that the invention is not bound by the structure and manner of operation of the mole vehicle of FIG. 4.

Furthermore, it should be noted that the validation of a suspected area by means of a "mole vehicle" as described herein, represents one example of validation. The invention is not bound by this example and this example should not be construed as limiting. The validation may be implemented by using other validation techniques, for example, a suspected area may be validated by digging from above the ground on top of the suspected area.

Figure 5:
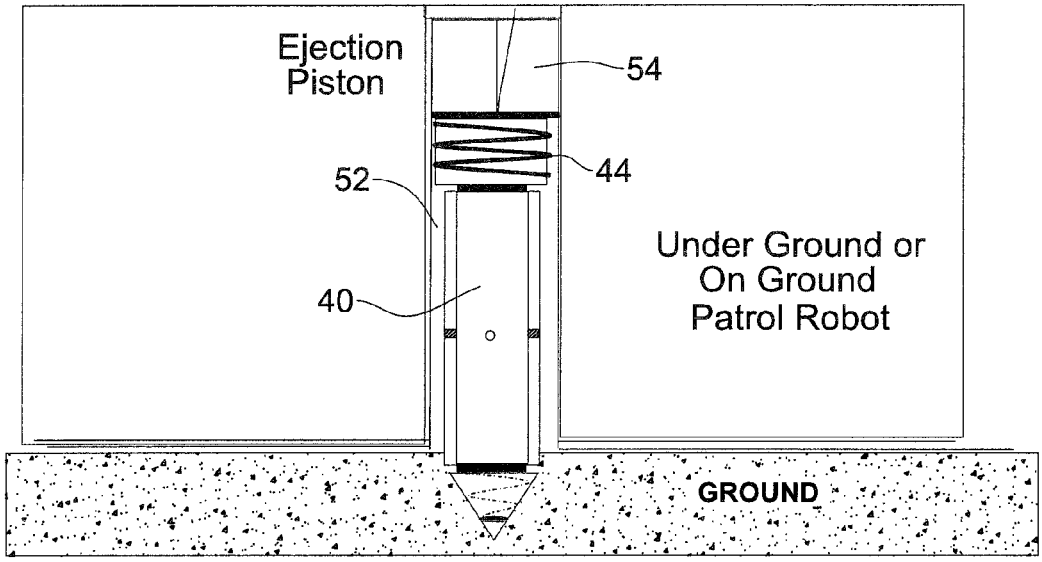
FIG. 5 illustrates a mole launcher mechanism fitted in the mobile vehicle of FIG. 3, in accordance with certain embodiments of the invention.

Attention is now drawn to FIG. 5 illustrating a mole launcher fitted in the mobile vehicle of FIG. 3, in accordance with certain embodiments of the invention. As shown the mole vehicle 40 is fitted in compartment 52 (of the mobile vehicle) and is capable of receiving power and communicating with the vehicle through cables 44 which are shown in their wrapped form. Also shown in FIG. 5 is launching means (including by way of example piston 54), which serve to eject the mole vehicle, activating the drilling head and allowing the power/communication cables to unwrap as the mole vehicle advances in drilling towards the suspected area.

Note that the invention is not bound by the structure and/or manner of operation of the launching means, described with reference to FIG. 5.

Before turning to describe the interaction with the command and control system it should be noted that the pipe array structure accommodating the mobile vehicles facilitates detection of tunnels (being a specific example of a suspected area) with higher level of certainty. Thus, as is well known, the ground is a problematic medium (having inherent very low signal/noise ratio) thereby imposing a limited detection range when utilizing known per se sensors such as acoustic/seismic and radar. Accordingly, when considering the prior art solutions, the prospects of detecting digging activity of a tunnel or the existence thereof is very low.

As is well known, "sensing" the ground at a distance of few 10s of meters from the location of the tunnel (which in many cases is dug at a depth of 30-40 meters under the ground), utilizing the known per se sensors is very problematic and in any case is likely to generate numerous false alarm indications. In contrast, in accordance with certain embodiments of the invention, the proposed pipe array structure copes with the specified limitation in that the distance between neighboring pipes of the array is designed to be within an effective operational distance, in accordance with the specification of the sensors. Thus, for example, reverting to FIG. 2, and as shown, the pipes are spaced apart at a distance of 14 meters (having a net "ground distance" of about 10 meters, when disregarding the pipe diameter) allowing for example the sensors of vehicle 23 to "cover" (or sense) the ground above pipe 13 as well as certain ground sections underneath the pipe. The ground section above pipe 12 (partially or fully covered by the sensors of vehicle 23 patrolling in pipe 13) is also "covered" by the sensors of vehicle 206 patrolling in pipe 12. In a similar fashion, the ground that extends between pipe 12 and pipe 11 is "covered" by the sensors of vehicle 206 (patrolling in pipe 12) and 208 (patrolling in pipe 11). The ground section below pipe 11 is likewise covered by the sensors of vehicle 208. The specified coverage scheme (which is provided by way of example only and is by no means binding) allows an efficient coverage of detection of tunnels dug (or existing) at any depth from 0 to 40 meters (which is a typical range of tunnels which are dug) whilst utilizing the effective operational specification of sensors (in terms of operationally feasible signal to noise ratio). In general the pipe array structure of the present invention allows an efficient coverage detection of suspected areas at a depth which is equal to a distance measured starting from the ground level and ending at a distance which is within an effective operational distance, in accordance with the specification of the sensors, measured from the deepest pipe.

Figure 6:
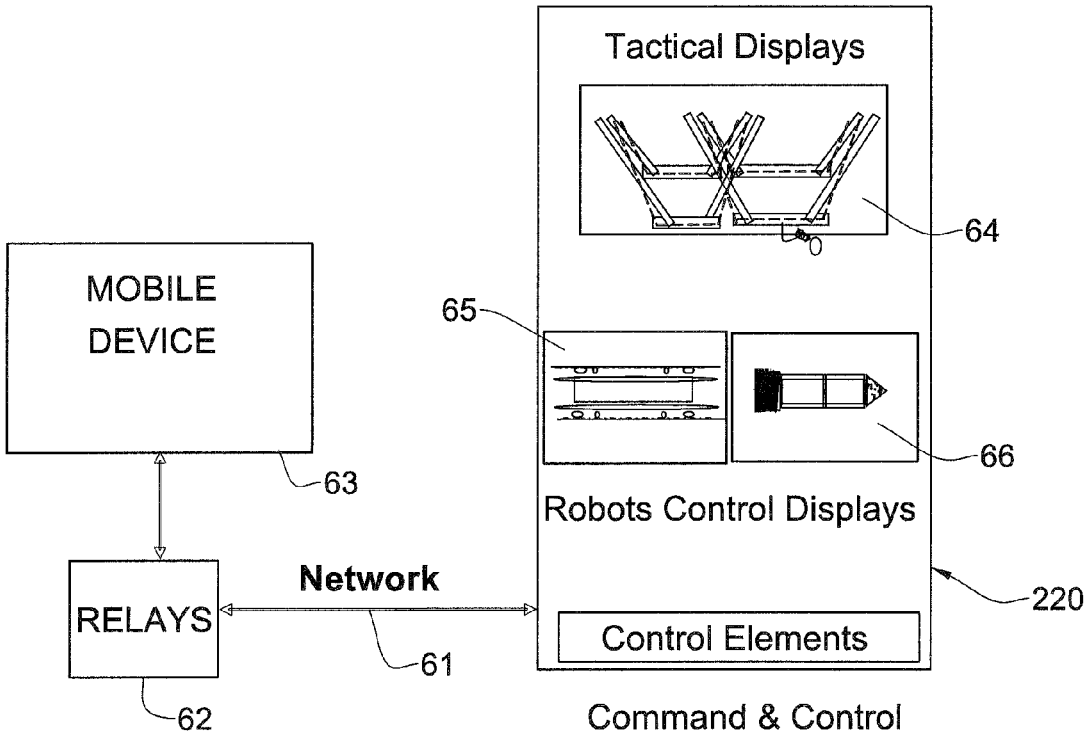
FIG. 6 illustrates schematically a generalized block diagram of a command and control system, in accordance with certain embodiments of the invention.

Bearing this in mind, attention is drawn to FIG. 6 illustrating schematically a generalized block diagram of a command and control system, in accordance with certain embodiments of the invention.

The command and control is generally configured to control at least the mobile vehicles and is capable of gathering and processing the vehicles' data and creating an updated situation awareness picture of the underground medium. Note that situation awareness is, in accordance with certain embodiments, a computer generated display which is an output of all the data gathered and processed by the C&C about the underground area of interest.

As shown in FIG. 6, the command and control system 220 communicates through a wired or wireless network 61 and relays 62 to mobile vehicle 63. The command and control system 60 includes a tactical displays module 64 coupled to the mobile vehicle module 65 which, in turn, is configured to control the operation of the mobile vehicle and a mole vehicle module 66 configured to control the operation of mole vehicle. In accordance with certain embodiments, the control of the mole until it reaches a certain distance from the suspected tunnel is done by the C&C automatically with tight monitoring of the operator. Once it reaches the distance (Rmin), the system switches to manual control by the operator, all as will be explained in greater detail with reference to FIG. 8. The vehicle serves as a mediator for communication between the operator and the mole and as a power source.

There is further provided a mole vehicle module 66 which shows the mole vehicle status and parameters to allow the manual control of the mole vehicle.

Figure 7:
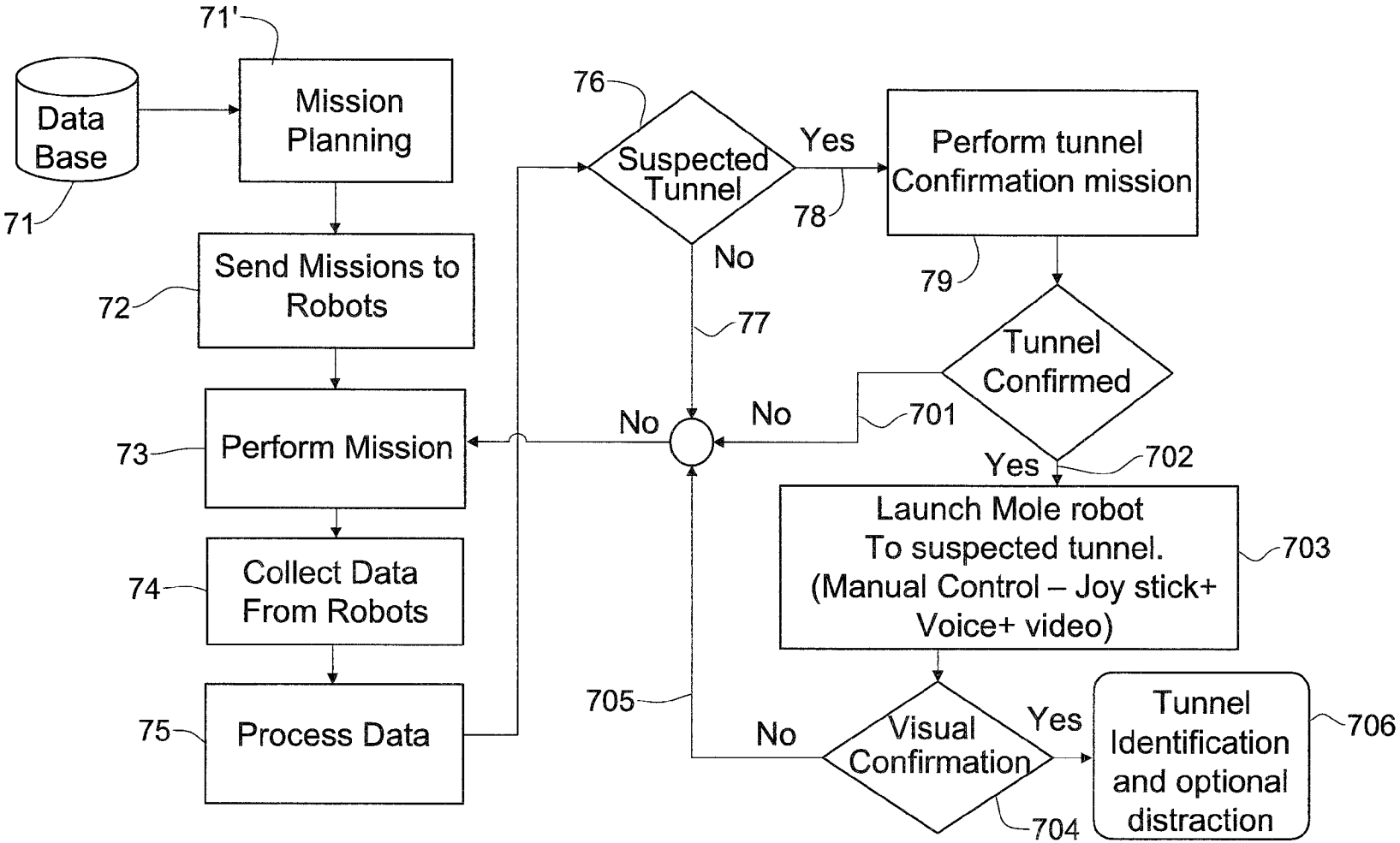
FIG. 7 illustrates a typical sequence of operation of a command and control system, in accordance with certain embodiments of the invention.

Bearing this in mind, attention is drawn to FIG. 7, illustrating a typical sequence of operation of a system of a command and control system, in accordance with certain embodiments of the invention. Thus, at the onset, a database 71 and mission planning function 71' interact to generate mission instructions. In accordance with certain embodiments, a mission comprises all the actions to be taken by all the vehicles in a certain underground area required to monitor and look for suspected tunnels. A mission is defined by certain parameters which determine the mission profile and objectives. These parameters define for example the underground route to be patrolled with waypoints, desired time for each point etc. and the sensors mode of operation required at each stage. The mission instructions are transmitted (through the RF network) to each of the mobile vehicles 72. The mobile vehicles attempt to comply with the mission 73 and provide periodic feedback data about the state of the mission 74. These data may include:

Position, speed and status data

Sensor (A/S and RADAR data)

Accurate time for synchronization

The C&C sends to the vehicle changes in mission data (if required) and commands in manual mode and synchronization accurate time. As mentioned above, the mission may be performed in a semiautonomous mode where the vehicle gets its mission from a Command and Control center, performs the mission autonomously, until it reaches a certain decision point (for example, as explained below with reference to step 704), sends data to the C&C and waits for operator approval or a new mission.

The data is then processed at the command and control system 75. In accordance with certain embodiments, the processing of the data includes a fusion of the different sensors and different vehicle data to one coherent picture (situation awareness picture) that can be understood by the operator. The processing is required in order to ascertain whether there is a suspected tunnel 76. Note that a suspected tunnel is, in accordance with certain embodiments, a change in the underground (as sensed by the sensors) caused by a new hole or new equipment. The decision that a certain event means a suspected tunnel is taken at the end by the operator based on the system recommendations. In cases where a suspected tunnel is not detected 77, the mobile vehicles continue to perform their tunnel detection mission 73. In cases where a suspected tunnel has been detected 78, there commences a tunnel validation mission 79. If a tunnel is not validated 701 then control is transferred again to "mission performed" function 73 for continuing the task of detecting suspected tunnels.

If, on the other hand, a tunnel is defined as suspected (702), a more deep processing on a suspected tunnel is initiated by launching a mole vehicle (e.g. by activating the mechanism described with reference to FIG. 5 above), for achieving final validation that the suspected tunnel is indeed a true tunnel. This is done by digging towards the tunnel and actually viewing the tunnel (by using images acquired by the mole vehicle's CCD and sent to the C&C). Control on the mole vehicle will be described in greater detail with reference to FIG. 8, below.

Reverting now to FIG. 7, based, inter alia, on visual and audio data received in real time from the mole vehicle (transmitted by the mole vehicle sensors to the mobile vehicle and therefrom through the network to the command and control system) as well as the suspected tunnel location as detected by the mobile vehicle data, the mole vehicle is guided to dig towards the suspected area 703. In cases where such a tunnel is not finally validated, there may be a supplemental manual stage where the mole vehicle is steered manually (e.g. by means of joy stick commands issued by the operator) from the command and control station 703 based, among other factors, on visual indications obtained from the CCD camera that is fitted on the mole vehicle and which acquires images at the vicinity of the drill head. In cases where visual (final) validation is achieved 704 there may optionally commence a tunnel destruction sequence utilizing the war head that is fitted on the mole vehicle head 706. Otherwise, in cases where no tunnel is validated, 705 the locating tunnel mission 73 continues.

The sequence of operations for locating tunnels as described with reference to FIG. 7 is by no means binding.

Note that in accordance with certain embodiments, the tactical display 64 is used to observe and look for the suspected tunnel (76) and to perform mission planning (71-73) and monitor the underground area in real time. The mobile vehicle's control display is used by the operator to monitor the underground patrol robot and to control the mole robot (703).

Figure 8:
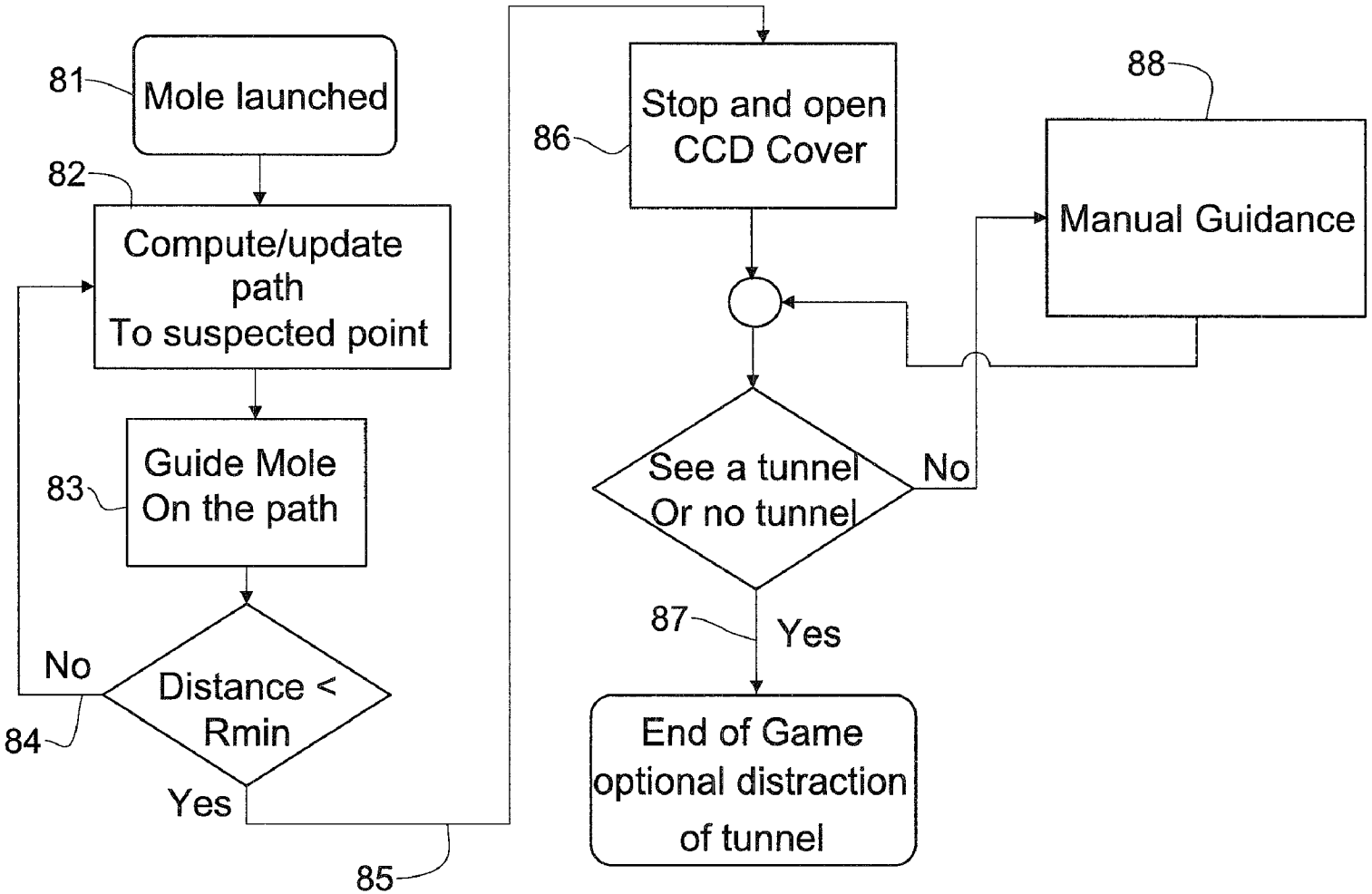
FIG. 8 illustrates a typical sequence of operations of command and control of the mole vehicle, in accordance with certain embodiments of the invention.

Attention is now drawn to FIG. 8 illustrating a typical sequence of operations of command and control of the mole vehicle, in accordance with certain embodiments of the invention.

As shown, when a mole is launched 81, (in response to detection of a suspected tunnel by the mobile vehicle), then the command and control computes or updates a path to the suspected area 82 (which, in accordance with certain embodiments is the shortest path to the suspected tunnel position and the vehicle's position, taking into account known obstacles) and the mole is guided to the suspected area 83. In cases where the distance of the mole vehicle to the targeted area is longer than a certain threshold 84 (>Rmin), then the mole is guided to the area in the manner specified. Note that the mole's self location is computed from navigation data and the unwired cable length.

If, on the other hand, the distance is smaller than the specified threshold 85 then the mole is stopped and the CCD cover fitted at the mole's head is opened 86 in order to commence an image acquisition sequence. The images are transmitted back to the mobile vehicle and therefrom to the command and control center and are displayed on the display 64 (see FIG. 6). If a tunnel is viewed by the operator 87, then a detection occurs and possibly a tunnel destruction sequence commences by activating a warhead that is fitted on the mole. In cases where a tunnel is not found, a manual session of guiding the mole by manual steering means commences (by using, for example, a joystick by the operator) 88. During the manual session, appropriate steering commands are sent from the command and control system to the mobile vehicle (in response to operator steering commands, say by the joystick) and are transmitted therefrom to the mole vehicle.

It should be noted that the sequence of operations of command and control of the mole vehicle described above with reference to FIG. 8 is by no means binding.

Unless specifically stated otherwise, as apparent from the following discussions, it is appreciated that throughout the specification discussions utilizing terms such as "processing", "computing", "calculating", "determining", "generating", "configuring" or the like, refer to the action and/or processes of a computer that manipulate and/or transform data into other data, said data represented as physical, e.g. such as electronic, quantities and representing the physical objects.

Embodiments of the present invention may use terms such as, processor, computer, apparatus, system, sub-system, module, unit, device (in single or plural form) for performing the operations herein. This may be specially constructed for the desired purposes, or it may comprise a general purpose computer selectively activated or reconfigured by a computer program stored in the computer. Such a computer program may be stored in a computer readable storage medium, such as, but not limited to, any type of disk including optical disks, CD-ROMs, magnetic-optical disks, read-only memories (ROMs), random access memories (RAMs), electrically programmable read-only memories (EPROMs), electrically erasable and programmable read only memories (EEPROMs), magnetic or optical cards, any other type of media suitable for storing electronic instructions that are capable of being conveyed via a computer system bus.

The processes/devices (or counterpart terms specified above) and displays presented herein are not inherently related to any particular computer or other apparatus, unless specifically stated otherwise. Various general purpose systems may be used with programs in accordance with the teachings herein, or it may prove convenient to construct a more specialized apparatus to perform the desired method. The desired structure for a variety of these systems will appear from the description below. In addition, embodiments of the present invention are not described with reference to any particular programming language. It will be appreciated that a variety of programming languages may be used to implement the teachings of the inventions as described herein.

As used herein, the phrase "for example," "such as" and variants thereof describing exemplary implementations of the present invention are exemplary in nature and not limiting. Reference in the specification to "one embodiment", "an embodiment", "some embodiments", "another embodiment", "other embodiments" "certain embodiments" or variations thereof means that a particular feature, structure or characteristic described in connection with the embodiment(s) is included in at least one embodiment of the invention. Thus the appearance of the phrase "one embodiment", "an embodiment", "some embodiments", "another embodiment", "other embodiments" "certain embodiments" or variations thereof do not necessarily refer to the same embodiment(s). It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination. While the invention has been shown and described with respect to particular embodiments, it is not thus limited. Numerous modifications, changes and improvements within the scope of the invention will now occur to the reader. In embodiments of the invention, fewer, more and/or different stages than those shown in FIG. 7 or 8 may be executed. In embodiments of the invention one or more stages illustrated in FIG. 7 or 8 may be executed in a different order and/or one or more groups of stages may be executed simultaneously. FIGS. 3, 4 and 6 illustrate a general system architecture in accordance with an embodiment of the invention. Certain modules in the Figs. can be made up of any combination of software, hardware and/or firmware that performs the functions as defined and explained herein. Certain modules in the Figs. may be centralized in one location or dispersed over more than one location. In other embodiments of the invention, the system may comprise fewer, more, and/or different modules than those shown in FIG. 3, 4 or 6. In other embodiments of the invention, the functionality of the system described herein may be divided differently into the modules. In other embodiments of the invention, the functionality of the system described herein may be divided into fewer, more and/or different modules than shown in the Figs. and/or the system may include additional or less functionality than described herein. In other embodiments of the invention, one or more modules shown in the Figs. may have more, less and/or different functionality than described.

While certain features of the invention have been illustrated and described herein, many modifications, substitutions, changes, and equivalents will occur to those skilled in the art. It is therefore to be understood that the appended claims are intended to cover all such modifications and changes as fall within the scope of the claims.

The invention claimed is:

1. A system for detecting a suspected area, comprising:

an underground pipe array disposed in a horizontal orientation and including at least two pipes, said at least two pipes being disposed at different depths, at a predefined vertical distance with respect to each other, each of said at least two pipes creating an underground pathway infrastructure for accommodating at least one mobile vehicle;

said at least one mobile vehicle being equipped with at least a sensing device and a navigation device for patrolling along the at least two pipes, in a coordinated manner, for detecting a detecting an underground suspected area outside the at least two pipes; said predefined vertical distance being designed to be within an effective operational distance of said sensing and navigation devices, the vertical distance between the at least two pipes allowing coverage of an area around the at least two pipes in order to enable detection of the underground suspected area outside the at least two pipes at a predefined depth.

2. The system according to claim 1, wherein one or more of said at least one mobile vehicle accommodate at least one mole vehicle capable, in response to detection of the underground suspected area, of being launched from the at least one mobile vehicle towards said underground suspected area for validating the underground suspected area.

3. The system according to claim 1, wherein said detecting the underground suspected area includes validating a suspected tunnel and wherein said validating includes validating that said suspected tunnel is a true tunnel.

4. The system according to claim 1, wherein each of the at least two pipes has an end section extending to a ground surface and wherein the predefined vertical distance between neighboring at least two pipes falls in a range of 6-10 meters.

5. The system according to claim 1, wherein at least two of said at least two pipes are interconnected, serving as an extended pathway for at least one of said at least one mobile vehicle.

6. The system according to claim 1 further comprising a command and control, configured to control the at least one mobile vehicle, gathering and processing data of the at least one mobile vehicle and creating an updated situation awareness picture of an underground medium.

7. The system according to claim 1, wherein the at least one mobile vehicle is configured to receive power through power units associated with an end section of said at least two pipes.

8. The system according to claim 1, wherein the at least two pipes are made of polyethylene.

9. The system according to claim 1, wherein said sensing devices include at least one sensor selected from a group consisting of Acoustic/Seismic (A/S), Radar and Magnetic flow sensors.

10. The system according to claim 1, wherein said at least one mobile vehicle is configured to move forward and backward along at least one of the at least two pipes and further capable of moving in a circumferential direction thereby allowing the at least one mobile vehicle to arrive to any desired location within the at least two pipes at high accuracy.

11. The system according to claim 1, wherein said navigation device includes a scanner for scanning a pathway for detecting obstacles that may interfere with a smooth motion of the at least one mobile vehicle as well as for navigating the at least one mobile vehicle.

12. The system according to claim 1, wherein the at least one mobile vehicle is operable in a semiautonomous mode, receiving a mission of the at least one mobile vehicle from a command and control, and performing the mission autonomously until the at least one mobile vehicle comes to a certain decision point the at least one mobile vehicle asks for operator approval or intervention.

13. The system according to claim 2, wherein said at least one mole vehicle further includes imaging means capable, in response to an activation command, of acquiring an image in a vicinity of the at least one mole vehicle and transmitting the image to the at least one mobile vehicle.

14. The system according to claim 2, wherein the at least one mole vehicle is further equipped with a warhead capable of being activated in response to validating the underground suspected area.

15. The system according to claim 2, wherein said at least one mole vehicle includes a motor and gear coupled to a drill head and being configured, in response to a launching command, to propel the at least one mole vehicle and activate the drill head outside at least one of the at least two pipes toward the underground suspected area in order to validate said underground suspected area is a true tunnel.

16. The system according to claim 6, wherein the at least one mobile vehicle is configured to communicate with the command and control through a communication network that utilizes at least one relay fitted at an end section of said at least two pipes.

17. A command and control of a system for detecting a suspected area, the command and control being configured to control at least mobile vehicles in an underground pathway, and being capable of gathering and processing data of the mobile vehicles and creating an updated situation awareness picture of an underground medium; the command and control are control further being configured to perform at least the following:

a. obtain a mission plan;

b. send mission commands to the mobile vehicles;

c. collect data from the vehicles;

d. process the so collected data;

e. in cases where the processed data indicates an underground suspected area outside the underground pathway, commence a validation sequence that includes sending to a mobile vehicle a launch command for launching a mole vehicle that is accommodated in the mobile vehicle, for guiding the mole vehicle to drill towards the underground suspected area outside the underground pathway in order to determine whether the underground suspected area is validated or not.

18. The system according to claim 17, wherein said validation sequence includes commencing a visual confirmation that includes sending a command for commencing an image acquisition sequence and receiving the and displaying an acquired image.

19. The system according to claim 17, wherein said processing includes collecting data from different sensors from each of the mobile vehicles with respective time tags of the mobile vehicles and fusing together the data from the different sensors to create a uniform underground situation awareness picture.

20. A mole vehicle in a system for detecting a suspected area, the mole vehicle being accommodated within a mobile vehicle capable of patrolling an underground pathway, the mole vehicle being capable, in response to detection of an underground suspected area outside the underground pathway, of being launched from the mobile vehicle towards said underground suspected area for validating the underground suspected area, the mole vehicle comprising a motor and a gear coupled to a drill head and being configured, in response to a launching command, to propel the mole vehicle and activate the drill head outside the underground pathway toward the underground suspected area.

21. The mole vehicle according to claim 20, further including imaging means capable, in response to an activation command, of acquiring an image in a vicinity of the mole vehicle and to transmit the image to the at least one mobile vehicle.

22. The mole vehicle according to claim 20, wherein the mole vehicle is further equipped with a warhead capable of being activated in response to validating the underground suspected area.

23. A method for detecting an underground suspected area, comprising:

(i) providing an underground pipe array disposed in a horizontal orientation and including at least two pipes, said at least two pipes being disposed at different depths, at a predefined vertical distance with respect to each other, each of said at least two pipes creating an underground pathway infrastructure for accommodating at least one mobile vehicle;

(ii) said at least one mobile vehicle patrolling along a respective pipe, in a coordinated manner, for detecting the underground suspected area outside the at least two pipes by said at least one mobile vehicle, each of said at least one mobile vehicle being equipped with at least a sensing device and a navigation device, said predefined vertical distance being designed to be within an effective operation distance of said sensing and navigation devices, the vertical distance between the at least two pipes allowing coverage of an area around the at least two pipes in order to enable detection of the underground suspected area at a predefined depth; and (iii) controlling the at least one mobile vehicle, gathering and processing data of the at least one mobile vehicle, and creating an updated situation awareness picture an underground medium.

24. The method of claim 23, further comprising:

(iv) launching at least one mole vehicle from the at least one mobile vehicle towards said underground suspected area, in response to detection of a of the underground suspected area; and (v) utilizing the at least one mole vehicle for validating the underground suspected area.

25. The method according to claim 23 wherein said detecting the underground suspected area includes validating a suspected tunnel and wherein said validating includes validating that said suspected tunnel is a true tunnel.

26. The method according to claim 23, wherein each of the at least two pipes has an end section extending to a ground surface and wherein the predefined vertical distance between neighboring at least two pipes falls in a range of 6-10 meters.

27. The method according to claim 23, wherein step (iii) is performed by a command and control, said command and control being connected to said at least one mobile vehicle through a communication network that utilizes at least one relay fitted at an end section of said at least two pipes.

28. The method according to claim 23, wherein the at least one mobile vehicle is configured to receive power through power units associated with an end section of said at least two pipes.

29. The method according to claim 23, wherein said at least one mobile vehicle is configured to move forward and backward along at least one of the at least two pipes and further capable of moving in a circumferential direction thereby allowing the at least one mobile vehicle to arrive to any desired location within the at least two pipes at high accuracy.

30. The method according to claim 23, wherein said navigation device includes a scanner for scanning a pathway to detect obstacles that may interfere with a smooth motion of the at least one mobile vehicle as well as for navigating the at least one mobile vehicle.

31. The method according to claim 24, wherein said at least one mole vehicle includes a motor and gear coupled to a drill head and being configured, in response to launching a command, to propel the at least one mole vehicle and activate the drill head toward the underground suspected area.

32. The method according to claim 31, wherein said at least one mole vehicle further includes imaging means capable, in response to an activation command, of acquiring an image in a vicinity of the at least one mole vehicle and transmitting the image to the at least one mobile vehicle.

33. The method according to claim 31, wherein the at least one mole vehicle is further equipped with a warhead capable of being activated in response to validating the underground suspected area.

* * * * *

UNITED STATES PATENT AND TRADEMARK OFFICE

CERTIFICATE OF CORRECTION

PATENT NO. : 8,396,610 B2
APPLICATION NO. : 12/509824
DATED : March 12, 2013
INVENTOR(S) : Yaacov Mashiach It is certified that error appears in the above-identified patent and that said Letters Patent is hereby corrected as shown below:

In the Claims:

Column 12
Line 13 - change "detecting a detecting" to --detecting--.

Signed and Sealed this
Sixteenth Day of July, 2013

Teresa Stanek Rea
*Acting Director of the United States Patent and Trademark Office*